US005971517A

United States Patent [19]

Kugumiya et al.

[11] Patent Number: 5,971,517

[45] Date of Patent: Oct. 26, 1999

[54] BAND BLADE BENDING AND CUTTING DEVICE WITH MARKING UNIT

[75] Inventors: Makoto Kugumiya; Akihide Okumura; Yasunori Kunimune, all of Osaka; Shouzou Kobayashi, Kyoto, all of Japan

[73] Assignee: Tsukatani Hamono Mfg. Co., Ltd., Osaka, Japan

[21] Appl. No.: 08/820,907

[22] Filed: Mar. 19, 1997

[30] Foreign Application Priority Data

Mar. 22, 1996 [JP] Japan ..... 8-065926

[51] Int. Cl.[6] ..... B41J 3/00; B26D 5/20

[52] U.S. Cl. ..... 347/2; 83/76.9

[58] Field of Search ..... 347/2; 72/294, 72/307, 310, 27, 28; 76/4; 83/76.9; 346/160.1, 141

[56] References Cited

U.S. PATENT DOCUMENTS

| | | | |
|---|---|---|---|
| 4,562,754 | 1/1986 | Archer et al. | 76/107 |
| 5,749,276 | 5/1998 | Song | 83/76.9 |

*Primary Examiner*—N. Le
*Assistant Examiner*—Thien Tran
*Attorney, Agent, or Firm*—Nikaido, Marmelstein, Murray & Oram LLP

[57] ABSTRACT

The object of the present invention is to provide a band blade automatic working device with a marking unit which can automatically perform a marking operation for indicating a position for forming a notch and improve a measurement accuracy thereof and an operation efficiency thereof, wherein a structure thereof and an operation thereof are simple. In order to achieve the object, a band blade bending device according to the present invention, for bending and cutting a band blade comprises a marking unit for marking a blade edge thereof so as to be visually recognized from a side of a sharpened surface of the blade edge, and a computer for supplying a driving signal for driving the marking unit based on a data for deciding a position of a concave portion which should be formed at a back of the band blade. Furthermore, the band blade bending device comprises a carrying roller for carrying longitudinally the band blade by way of repeating a carry and a stop, and a band blade bending unit for bending and cutting the band blade. Moreover, it includes a computer for driving and controlling successively the marking unit and the band blade bending unit. The marking unit marks the blade edge of the band blade so as to be visually recognized from sides of both sharpened surfaces of the blade edge. In addition, the marking unit is an imprinter having a rubbery elastic body on a tip thereof for imprinting by way of exuding an ink on a surface of the rubbery elastic body, or an ink jet printer.

6 Claims, 4 Drawing Sheets

BAND BLADE BENDING AND CUTTING DEVICE WITH MARKING UNIT

BACKGROUND OF THE INVENTION

1. Field of the Invention

The present invention relates to a band blade automatic working device for automatically performing predetermined bending and cutting works a Thomson blade for pressingly cutting a paper, a plastic sheet and leather or the like and a straight shape band blade such as pressing horizontal rule for folding a paper box or the like.

2. Description of the Prior Art

As a band blade automatic working device, a technique for bending the band blade at a desirable radius of curvature and bending angle, and cutting the band blade in a predetermined measure by a computer control has already been used in practice.

Thus, the worked band blade is embedded in a groove formed on a substrate to make a sheet of pushing cutter die. The groove has a structure to be pierced from an upper surface of the substrate to a bottom surface thereof. In case of forming the grooves on the substrate successively, the substrate is separated. As a means for avoiding it, in order to prevent the grooves from being continuous, the substrate has conventionally been appropriately provided with discontinuous portions of the groove, and at each position corresponding to the discontinuous portions, a back portion 51 of a band blade 50 is provided with a concave portion or a bridge 16 as shown in FIG. 5. However, in working the bridge 16, a series of manual operations are performed as below: visually recognizing the discontinuous portions of the substrate, marking the band blade 50, forming the bridge 16 based on marks, thereby having a defect wherein the operation efficiency is low.

Moreover, the band blade 50 is provided with a notch or a connection 17 formed on a blade edge 52 thereof except the blade edge 52 and a portion adjacent to the blade edge 52 corresponding to the bridge 16. In case that, as soon as completing a step for pressingly cutting a development view of a paper container, a corrugated fibreboard container or the like, punched useful portions and unnecessary portions, i.e., portions adjacent to the punched useful portions are separated, it is difficult to treat them and the steps thereafter is more complicated. Therefore, the connection 17 has an arrangement wherein the connecting part is formed in order to carry a connected sheet as one body until reaching a missing leaf step. Then, the connection 17 is usually formed by a grinding work. A size of the connection 17 is different according to each punched paper thickness. For example, a connecting work has a width of about 1 mm, a depth of about 1 mm and more than 4 connections are usually arranged on a pair of punching dies. The connection 17 is formed in a final step wherein the bridge 16 cannot be visually recognized after embedding the band blade 50 in the groove of the substrate. As a result, working the connection 17 is performed at the blade edge or the portion adjacent to the blade edge, thereby causing an inconvenience to overlap the bridge 16. However, the portions forming the connection 17 requires not to overlap the bridge 16 so as to maintain a strength of the band blade 50. Therefore, in working the connection 17, the substrate where the worked band blade is embedded is marked so as to indicate the "connecting" position, whereby a blade edge has conventionally been formed by a grinding work based on marks.

As mentioned above, the operation for forming the bridge 16 and the connection 17 is still performed visually with the result that there are defects wherein the measuring accuracy is low and the operation efficiency is bad.

OBJECT OF THE PRESENT INVENTION

Figure 1:
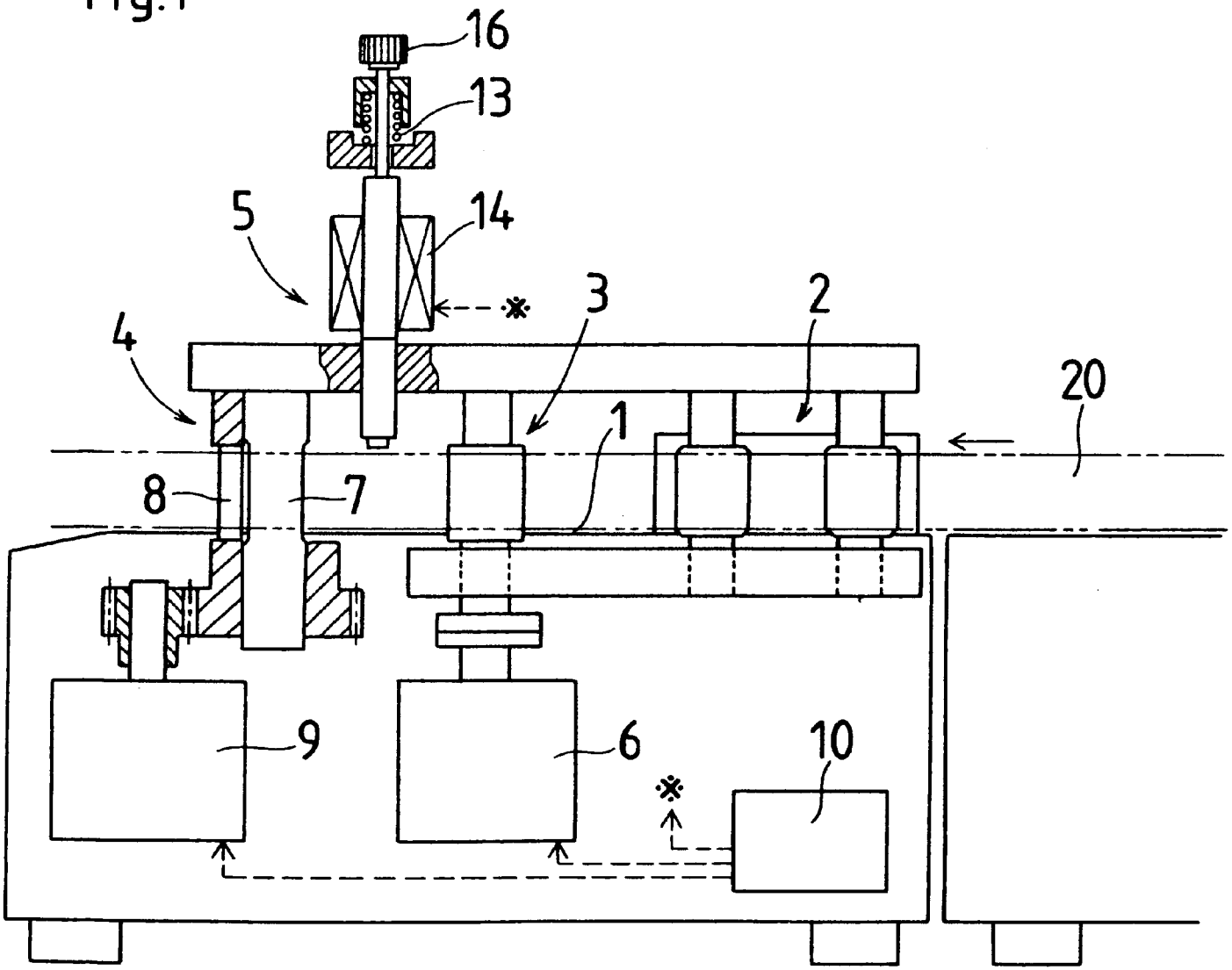
FIG. 1 is a structural view illustrating an arrangement of an embodiment according to the present invention.

The object of the present invention is to provide a band blade automatic working device including a marking unit which can automatically perform a marking operation for indicating a working position of a bridge formed on a band blade and improve a measurement accuracy thereof and an operation efficiency thereof, whose structure and operation are simple.

In order to overcome the above object, the band blade bending device of the present invention for bending and cutting a band blade comprises marking means for marking a blade edge thereof so as to be visually recognized from a side of a sharpened surface of the blade edge, and controlling means for supplying a driving signal for driving the marking means based on a data for deciding a position of a concave portion which should be formed at a back of the band blade.

By the structure, a mark visually recognized from a side of the blade edge is indicated, thereby making it possible to recognize the mark even in case of performing any bending work, and improve an operation efficiency and working accuracy of the bridge working. In addition, the mark is marked on the blade edge of the bridge forming position, whereby, even after embedding the band blade in the groove, a position for performing a grinding work for a "connection" can be recognized, thereby preventing the position of the "connection" from overlapping the position of the bridge.

Moreover, the band blade bending device of the present invention may structurally comprise carrying means for carrying longitudinally the band blade by means of repeating a carry and a stop, and working means for bending and cutting the band blade.

In addition, the controlling means may structurally drive and control successively the marking means and the working means to the blade edge carried by the carrying means.

In the arrangement, bending, cutting and marking are performed in a series of operations, a carrying arrangement for carrying the band blade can be used in common as it is, during a one-time carrying step, all of bending, cutting and marking can be completed. As a result, a required time for the whole operations can be shortened and a measurement accuracy in these steps can be improved.

The above marking means may structurally mark the band blade edge so as to be visually recognized from sides of both sharpened surfaces of the blade edge.

In case of employing the structure, marks can be visually recognized from the both sides of the blade edge, thereby easily working the blade from each direction in a working step.

Furthermore, according to the present invention, the marking means may have an arrangement in which an imprinter having a rubbery elastic body on a tip thereof for imprinting by means of exuding an ink on a surface of a rubbery elastic body reciprocates toward the blade edge.

In case of employing the marking unit, it has an arrangement wherein an approximate center of the imprinting surface touches the blade edge, whereby an elastic transformation of the imprinting surface can make the mark visually recognized from the both sides of the blade edge be imprinted, a structure of the marking means is simple and a cost thereof is cheap.

In addition, the marking means may structurally be an ink jet printer for injecting the ink from the band blade edge to the sharpened sides of the band blade.

According to this structure, a tip of a nozzle is only arranged to be adjacent to the band blade edge, thereby performing a marking work so as to be visually recognized from the both sides of the blade edge. Moreover, there is no mechanical movable portion, thus realizing a silent operation environment and also making it possible to select various marking patterns.

DETAILED DESCRIPTION OF THE PREFERRED EMBODIMENTS

Referring now to the drawings, an embodiment of the invention is described in detail below.

Figure 2:
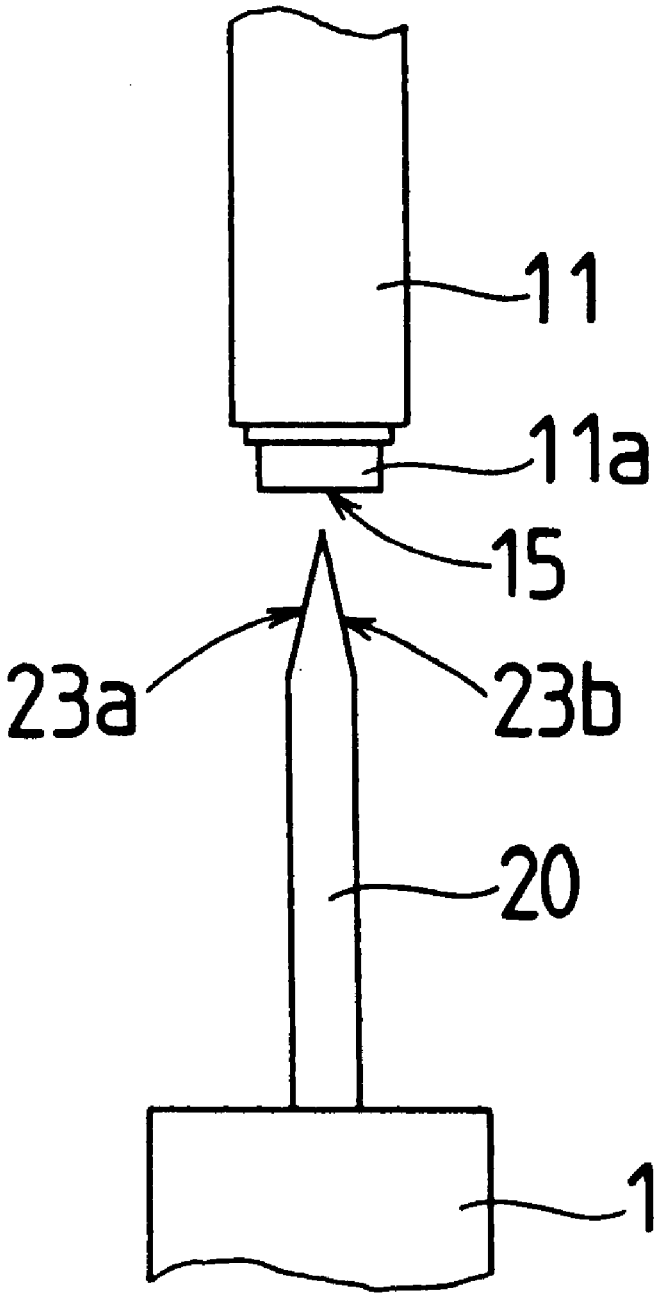
FIG. 2 is a diagram facing a traveling direction of the band blade of a marking unit applied to an embodiment according to the present invention.

FIG. 1 is a structural view illustrating an arrangement of an embodiment according to the present invention. FIG. 2 is a diagram facing a traveling direction of a band blade of a marking unit applied to the embodiment according to the present invention.

On a table 1, a leveler 2 for straightening a winding deformation of a band blade wound in a roll, a carrying roller 3 for carrying a band blade 20, whose blade edge fed from the leveler 2 faces an upper side, to a band blade bending unit 4, and a marking unit 5 are disposed between the carrying roller 3 and the band blade unit 4. The carrying roller 3 makes the band blade 20 repeat an action including a carry or a stop. The action is performed by driving a stepping motor 6, which can be controlled by a computer 10. Moreover, the band blade bending unit 4 comprises a fixing die 7 having a slit which the band blade 20 passes, a movable die 8 for applying a pressing force to sides of the band blade 20 by approaching a band blade exit of the slit of the fixing die 7 and fluctuating, and a stepping motor 9 for making the movable die 8 fluctuate by a predetermined amount in a predetermined direction. Driving of the stepping motor 9 is controlled by the computer 10, thus repeating a posing state for making the band blade 20 pass as it is, a predetermined pressing step and a micro carrying step of the carrying roller 3, thereby bending the band blade 20 so as to have a desirable radius of curvature and bending angle. After that, the strong bending work is repeated alternatively in either direction so that the band blade 20 is cut owing to fatigue failure.

In addition, the marking unit 5 applied to the present invention includes an imprinter 11 supported to be able to fluctuate in a vertical direction of the surface of the table 1, an electromagnetic coil 14 and a compressing spring 13 for making the imprinter 11 fluctuate, wherein the imprinter 11 fluctuates between an imprinting state wherein magnetization of the electromagnetic coil 14 controlled by the computer 10 makes the imprinter 11 fluctuate to a lower side and a retrieval state owing to the compressing spring 13 so as to repeat these states alternatively. On the upper portion of the imprinter 11, an adjusting screw 16 for adjusting a height of the imprinting surface 15 in the retrieval state is disposed. Moreover, the imprinter 11, whose tip is a soft rubbery elastic body, is provided with an imprinting portion 11*a* made of a sponge material, having fine ink passages with the result that the imprinting surface 15 of the surface of the imprinting portion 11*a* can be transformed in an optional shape. In addition, a back of the imprinting portion 11*a* includes a cartridge for storing the ink.

In the marking unit having the above structure, in case that the imprinter 11 is in the retrieval state, the imprinting surface 15 approaches a blade edge 22 of the band blade 20 and the imprinting surface 15 is parallel with the surface of the table 1, and the imprinting surface 15 is maintained at a position wherein a center line of the imprinting surface 15 corresponds to the edge 22 of the band blade 20. In the imprinting state, the imprinting surface 15 is transformed owing to elasticity to contact on the both sharpened surfaces 23*a*, 23*b* of the band blade 20, thereby marking the both sharpened surfaces 23*a*, 23*b*.

Figure 3:
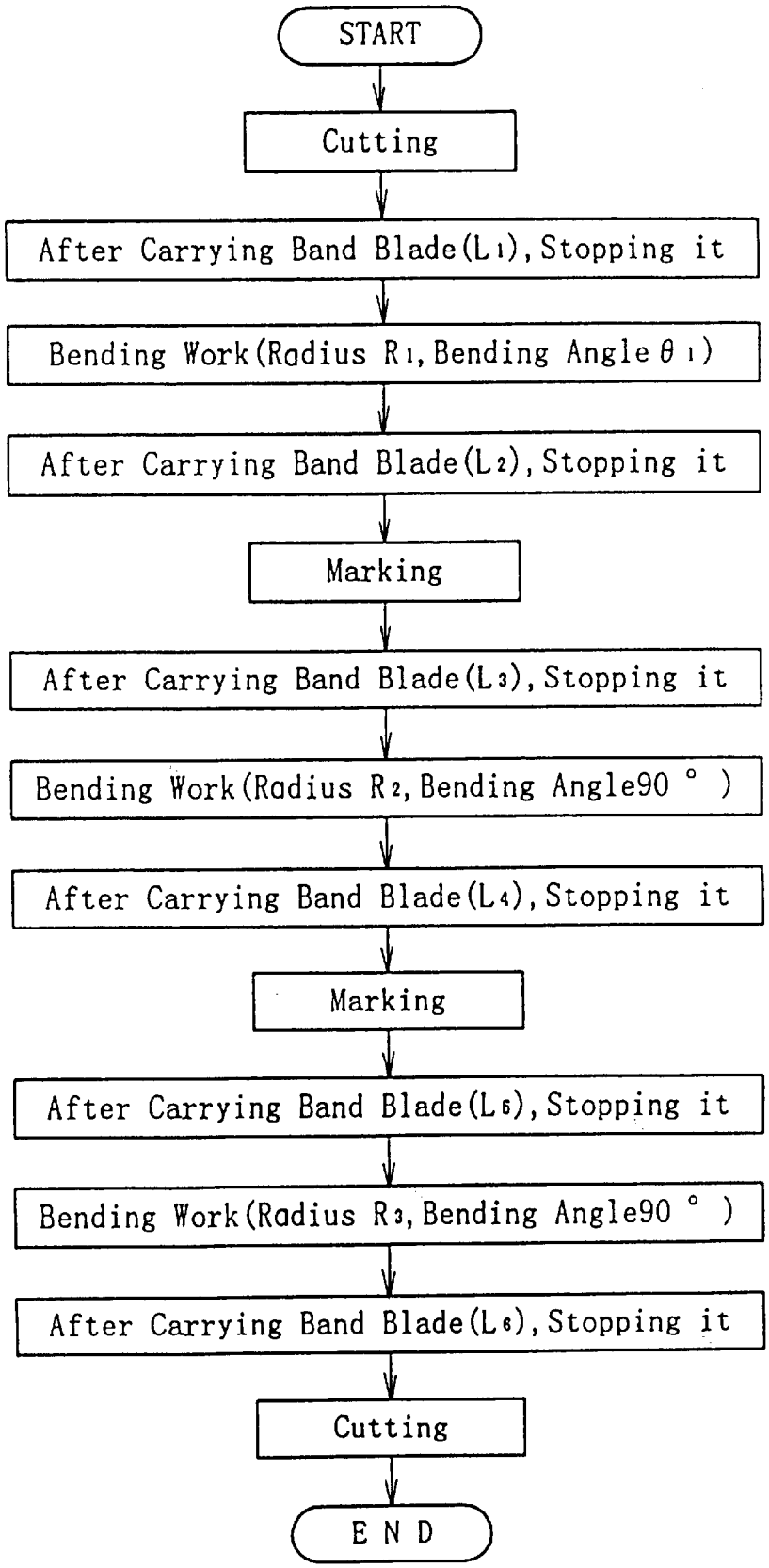
FIG. 3 is a flow chart illustrating an example of a processing program of a computer of the embodiment according to the present invention.
Figure 4:
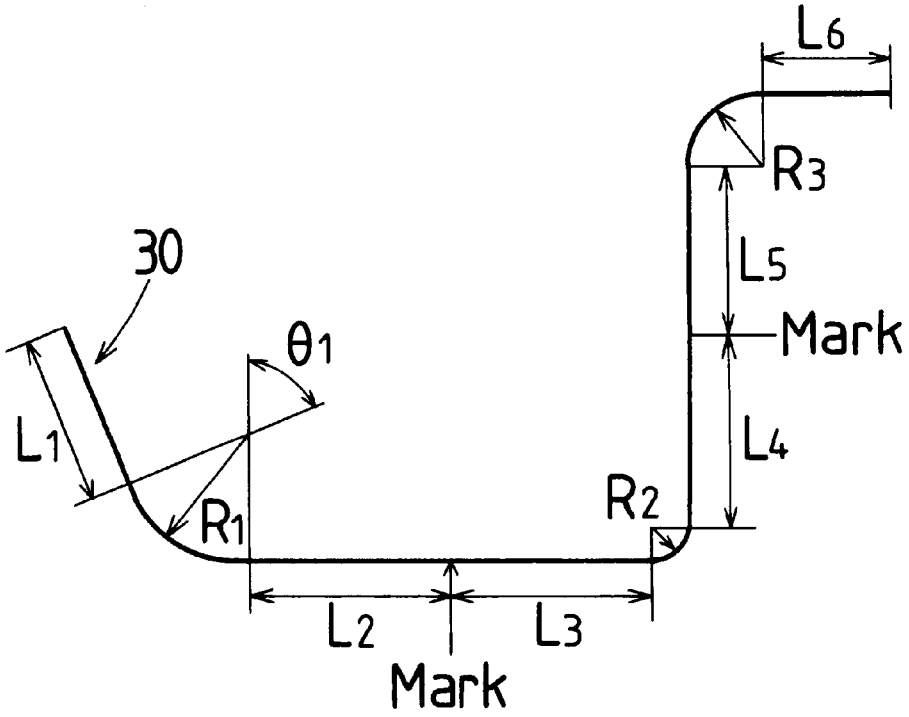
FIG. 4 is a plan view illustrating a shape of the band blade worked by the processing program in FIG. 3.
Figure 5:
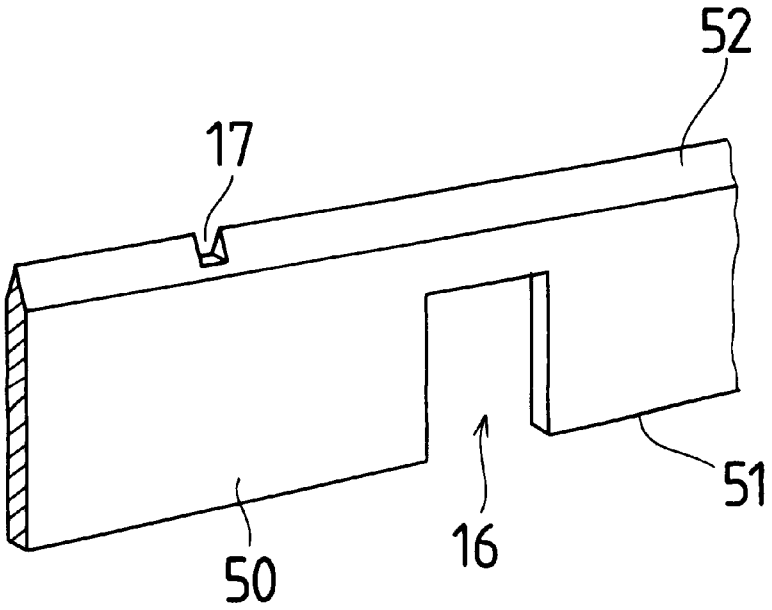
FIG. 5 is a perspective view of the band blade employed for describing prior art.

FIG. 3 is a flow chart illustrating an embodiment of a series of a band blade working procedure by a program of the computer 10 in the embodiment according to the present invention. FIG. 4 illustrates a shape of a blade edge line of the worked band blade. The view shown in FIG. 4 is the same image as one displayed on a display unit of the computer 10, which enables a marking position to be recognized prior to working.

As shown in FIG. 1, the computer 10 is programmed so that the stepping motor 6 for driving the carrying roller 3, the stepping motor 9 for driving the band blade bending unit 4 and driving of the electromagnetic coil 14 may be sequentially controlled. By the structure, a marking process, a bending work and a cutting work are sequentially performed in series while carrying the band blade 20.

The band blade working procedure is concretely described based on FIGS. 3 and 4 as below: cutting a band blade 30, carrying it at a length of $L_1$, stopping it, repeating alternatively a small amount of a bend and a small amount of a carry, thereby performing a bending work to the band blade 30 to have a radius $R_1$, a bending angle $Ø_1$, after that, carrying it at the length of $L_2$, stopping it, marking it, and carrying it at the length of $L_3$, stopping it, repeating alternatively a small amount of the bend and a small amount of the carry thereafter, thereby performing a bending work to the band blade 30 to have the radius $R_2$, the bending angle 90°; after that, carrying it at the length of $L_4$, stopping it, marking it, carrying it at the length of $L_5$, stopping it, repeating alternatively a small amount of the bend and a small amount of the carry thereafter, thereby performing a bending work to the band blade 30 to have the radius $R_3$, the bending angle 90°, after that, carrying it at the length of $L_6$, stopping it, and performing a further cutting work to it, leading to completing the procedure.

Although the marking unit 5 in the present embodiment is disposed between the carrying roller 3 and the band blade bending unit 4, it may be disposed, for example, at a subsequent stage of the band blade bending unit 4.

Although the embodiment of a working step employing the present embodiment describes the step wherein the marking step and the bending work are subsequently repeated, thereby manufacturing a work, other steps may be admitted: for example, a step for marking a whole of the band blade in advance before reversely carrying the marked band blade, and bending it while carrying it forward again, is admitted.

Furthermore, the marking unit 5 may be not only an arrangement employing the imprinter 11 but also one employing an ink jet printer. An arrangement employing the ink jet printer is described as below.

According to a theory of the ink jet printer, applying an ultrasonic vibration to an ink nozzle makes an ink flow drop, fly by charging an ink drop and pass through an electric field where the flying charged drop is controlled, thus causing curvature controlled to a flying route of the ink flow. By controlling the electric field while making the ink nozzle relatively run on a printed body, characters, symbols, line patterns or the like commanded by the control section can be printed on the printed body. Unnecessary dots in printing characters, symbols or the like, or unnecessary ink drops in spaces and pauses are accepted in an ink pot disposed outside printing extent, collected as drains to recycle them.

The band blade automatic working device according to the embodiment of the present invention may have only a function for marking the blade edge of the band blade so as to be visually recognized from the both sides. Therefore, an arrangement and a control of the ink jet printer are extremely simplified. In case of employing the ink jet printer having a ready-made scanning function as it is, only a control function for printing only a numeral "1" or a roman character "I" may be driven and the ink nozzle may be disposed so that the ink is dropped to the both sharpened surfaces of the blade edge. Moreover, in case of having an arrangement for applying the ink nozzle to the vibration and turning an ink injecting direction, it is unnecessary to be provided with a charging unit and an electric field controller. Furthermore, the ink nozzle is divided into two to be respectively disposed oppositely at the both sharpened surfaces, whereby it is unnecessary to be provided with any of an arrangement for turning the ink injecting direction, the charging unit and the electric field controller.

Employing the ink jet printer can mark continuously the both ends of the bridge or the portion between the both ends thereof, except marking a center of the bridge.

Although the present embodiment has given a description of marking the both sharpened surfaces of the band blade edge, it may be admitted to mark only one sharpened surface thereof. As a result, it may be selected on a demand.

What is claimed is:

1. A device for bending and cutting a band blade comprising:

marking means for marking a blade edge of the band blade in a manner that is visually recognizable from a side of a sharpened surface of said blade edge, and controlling means for supplying a driving signal for driving the marking means based on data used to determine a position for forming a concave portion at a back of the band blade.

2. A device according to claim 1 further comprising:

carrying means for carrying longitudinally the band blade by repeating a carry and a stop, and working means for bending and cutting the band blade.

3. A device according to claims 1 or 2, wherein the controlling means drives and controls successively the marking means and the working means to the blade edge carried by the carrying means.

4. A device according to claims 1, or 2, wherein the marking means marks the blade edge of the band blade in a manner that is visually recognizable from both sides of a sharpened surface of the blade edge.

5. A device according to claims 1, or 2, wherein the marking means is an imprinter having a rubbery elastic body on a tip thereof for imprinting by exuding an ink on a surface of the rubbery elastic body, and the marking means has an arrangement for reciprocating toward the blade edge.

6. A device according to claims 1, or 2, wherein the marking means is an ink jet printer for injecting ink from the band blade edge to sides of sharpened surfaces of the band blade.

* * * * *